US007273958B2

(12) United States Patent
Bournay et al.

(10) Patent No.: US 7,273,958 B2
(45) Date of Patent: Sep. 25, 2007

(54) PROCESS FOR ISOMERIZATION OF A $C_7$ FRACTION WITH OPENING OF NAPHTHENE RINGS

(75) Inventors: Laurent Bournay, Lyons (FR); Dominique Casanave, Villeurbanne (FR); Elsa Jolimaitre, Lyons (FR); Jean-François Joly, Lyons (FR); Paul Broutin, Chaponost (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 323 days.

(21) Appl. No.: 10/887,223

(22) Filed: Jul. 9, 2004

(65) Prior Publication Data

US 2005/0043576 A1 Feb. 24, 2005

(30) Foreign Application Priority Data

Jul. 11, 2003 (FR) ..... 03 08570

(51) Int. Cl.
*C07C 2/00* (2006.01)

(52) U.S. Cl. ..... 585/324; 585/480

(58) Field of Classification Search ..... 585/324, 585/480

See application file for complete search history.

(56) References Cited

U.S. PATENT DOCUMENTS

| | | | |
|---|---|---|---|
| 2,915,571 A | 12/1959 | Haensel | |
| 5,055,633 A | 10/1991 | Volles | |
| 5,334,792 A | 8/1994 | Del Rossi et al. | |
| 5,382,731 A | 1/1995 | Santiesteban et al. | |
| 5,463,155 A | 10/1995 | Galperin et al. | |
| 6,156,950 A | 12/2000 | Benoit et al. | |
| 6,198,014 B1 * | 3/2001 | Alario et al. | 585/480 |

FOREIGN PATENT DOCUMENTS

| | | |
|---|---|---|
| EP | 0 473 828 | 3/1992 |
| EP | 0 922 748 | 6/1999 |
| FR | 2 828 205 | 2/2003 |

* cited by examiner

*Primary Examiner*—Glenn Caldarola
*Assistant Examiner*—Prem C. Singh
(74) *Attorney, Agent, or Firm*—Millen, White, Zelano & Branigan, P.C.

(57) ABSTRACT

A process for the production of an isomerate with a RON that is at least equal to 80 and that contains less than 1% by weight of aromatic compounds, starting with a fraction consisting mostly of hydrocarbons with 7 carbon atoms, and containing paraffins, naphthenes, and aromatic compounds in any proportion is described. Said process uses at least one isomerization unit, at least one unit for opening naphthene rings, and at least one separation unit; these units are combined in such a way as to recycle, to exhaustion, methyl cyclohexane, toluene, and normal paraffins and mono-branched paraffins.

17 Claims, 1 Drawing Sheet

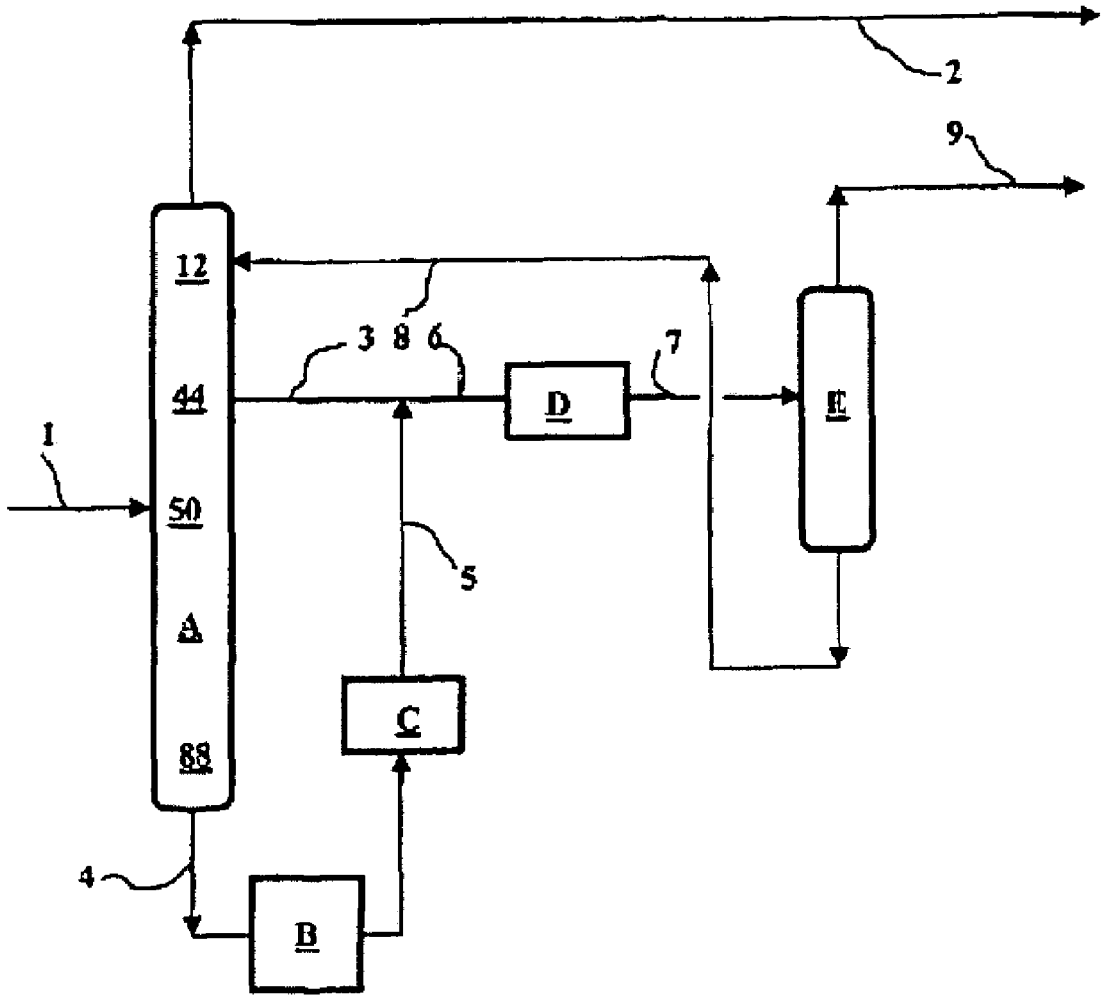
2
9
12
3
8
6
7
44
D
E
1
50
5
A
C
88
4
B

PROCESS FOR ISOMERIZATION OF A $C_7$ FRACTION WITH OPENING OF NAPHTHENE RINGS

FIELD OF THE INVENTION

The elimination of lead alkyls in automobile gasolines, and more recently the limitation in the content of aromatic compounds in gasolines (35% in 2005 compared to 42% currently) has generated development of processes for production of branched paraffins that have a clearly better octane number than linear paraffins; and in particular development of processes for isomerization of normal paraffins into branched paraffins. These processes currently are growing in importance in the petroleum industry.

The current methods of improving naphtha ($C_5$-$C_{10}$ fraction) resulting from atmospheric distillation of petroleum most often comprise fractionation that produces:

- a light naphtha ($C_5$-$C_6$ fraction), which is sent to isomerization,
- a heavy naphtha ($C_7$-$C_{10}$ fraction), which is sent to catalytic reforming.

The isomerization product (or isomerate) is free of aromatic compounds, in contrast to the reformate, which generally contains a significant amount of them because of the dehydrocyclization reactions.

Isomerate and reformate are usually sent to the gasoline pool, in which other components can also come into play, such as gasoline obtained from catalytic cracking in a fluidized bed (FCC), or additives such as methyl tert-butyl ether (MTBE).

Aromatic compounds have high octane numbers that are favorable for their use in spark ignition engines, but for environmental reasons, the increasingly strict specifications lead to reducing the total aromatic compound content in gasolines.

The European specification provides, starting in 2005, for reducing, to a maximum of 35% by volume, the total aromatic compound content in premium grade gasolines, while currently said content is on the order of 42% by volume.

Thus, it is imperative to develop new processes making it possible to synthesize gasolines free of aromatic compounds but having high octane numbers.

Among the latter, the process described in French Patent Application FR-A-2,828,205 relates to a the isomerization of a $C_5$-$C_8$ feedstock, the naphtha $C_{8+}$ fraction being sent to reforming. The $C_5$-$C_8$ fraction is first separated into two fractions, a first fraction rich in $C_5$-$C_8$ and a second fraction rich in $C_7$-$C_8$, these two fractions being treated separately in separate reaction zones.

This patented invention relates more particularly to the isomerization of the second fraction that is rich in $C_7$-$C_8$, which in practice will be essentially a $C_7$ fraction.

The table below provides the research octane number (RON) of the main $C_7$ hydrocarbon-containing compounds that are present in this second fraction, as well as their normal boiling points.

| | RON | teb (boiling point) (° C.) |
|---|---|---|
| Trimethyl 2-2-3 butane | 112.1 | 80.8 |
| Dimethyl 2-2 pentane | 92.8 | 79.2 |
| Dimethyl 2-4 pentane | 83.1 | 80.5 |

-continued

| | RON | teb (boiling point) (° C.) |
|---|---|---|
| Dimethyl 3-3 pentane | 80.8 | 86 |
| Dimethyl 2-3 pentane | 91.1 | 89.7 |
| Methyl-2 hexane | 42.4 | 90 |
| Methyl-3 hexane | 52 | 91.9 |
| Ethyl-3 pentane | 65 | 93.4 |
| n-Heptane | 0 | 98.4 |
| Dimethyl-1,1 cyclopentane | 92.3 | 87.8 |
| Cis-Dimethyl-1,3 cyclopentane | 79.2 | 90.8 |
| Trans-dimethyl-1,3 cyclopentane | 80.6 | 91.7 |
| Trans-dimethyl-1,2 cyclopentane | 80.6 | 91.8 |
| Methyl cyclohexane | 74.8 | 100.9 |
| Ethyl-cyclopentane | 67.2 | 103.4 |
| Toluene | 120 | 110.7 |

Study of the octane numbers of the various $C_7$ isomers shows that the isomers of normal heptane (n-$C_7$) exhibit several branches, i.e., the di- and tri-branched isomers have a high enough octane number (80 to 100) to be able to be sent directly into the gasoline pool.

In contrast, isomers having only a single branching, or that are monobranched, have insufficient octane numbers (42 for methyl-2 hexane; 52 for methyl-3 hexane) to be mixed with the gasoline pool. These compounds must be transformed to the greatest possible extent into di- and/or tri-branched paraffins in the isomerization process.

Concerning normal heptane, the problematic issue is even greater: its octane number being zero, it must absolutely be converted to exhaustion during the isomerization process, i.e. up to 1% by weight of nC7 can be tolerated in the isomerate but, if possible, less than 0.5% by weight.

On the other hand, the toluene present in the fresh feedstock is totally hydrogenated to methyl cyclohexane, either in a specific hydrogenation unit or in a unit for isomerization of paraffins. The methyl cyclohexane that is also present in the feedstock in a significant quantity is affected very little by isomerization, the isomerization catalysts not readily promoting the opening of naphthene rings in their usual conditions of use. The $C_7$ isomerate obtained can contain up to 30% by weight of methyl cyclohexane: this compound, whose RON is less than 75, noticeably decreases the RON of this $C_7$ isomerate. So as to maximize the RON of the isomerate produced, it would thus be useful to convert the methyl cyclohexane into paraffins in a unit for opening rings, so as to reduce the methyl cyclohexane content of the $C_7$ isomerate. Thus, Patent Application WO 02/07881 relates to a catalyst with a base of iridium on silica-alumina making it possible to carry out the reaction of opening naphthene rings. Patent U.S. Pat. No. 5,382,731 describes a sequence of a reactor for opening naphthene rings followed by an isomerization reactor in the presence of hydrogen and chlorine, this group of reactions being applied to a feedstock with 6 carbon atoms comprising 50% by weight of normal hexane, 14.5% by weight of methyl cyclopentane, 32% by weight of cyclohexane, and 3.9% by weight of benzene. Patents U.S. Pat. Nos. 5,463,155 and 5,770,042 describe a sequence of a reactor for opening naphthene rings followed by an isomerization reactor completed by normal paraffin/isoparaffin separation in Patent U.S. Pat. No. 5,770,042. The feedstock used is a naphtha defined as a petroleum fraction having 4 to 7 carbon atoms, with a $C_7$ concentration preferably limited to 20% by weight. Finally, Patent U.S. Pat.

No. 2,971,571 describes a sequence of isomerization followed by a distillation column and a reactor for opening rings.

The problem that the present invention seeks to solve is that of the production of gasoline bases starting with a $C_7$ fraction that correspond to a research octane number (RON) of at least 80, with an aromatic compound content limited to 1% by weight, which makes it possible to anticipate the new standard for the specifications of the gasoline pool.

The solution proposed in this invention consists of a combination of known units, namely, at least one isomerization unit and at least one unit for opening naphthene rings, the combination having as a characteristic the ability to exhaust methyl cyclohexane and normal paraffins and monobranched $C_7$ paraffins responsible for lowering the octane number. Exhaustion is defined as the fact of converting said compounds by systematic recycling in an appropriate unit of the combination of units integrated into the process according to the invention, said compounds having first been isolated in at least one separation unit.

The numerous variants that will be described in the text below all have in common this notion of exhaustion.

Further, the toluene present in the fresh feedstock is totally hydrogenated, which makes it possible to limit the aromatic compound content in the isomerate produced.

The prior art described above will produce, individually, the units that are used in this invention, but it does not combine them in the manner described by the applicant, i.e., with recycling normal paraffins and monobranched paraffins to exhaustion, in particular nonconverted, normal paraffins and monobranched $C_7$ paraffins, on the one hand, and naphthenes, in particular methyl cyclohexane, and aromatic compounds, in particular toluene, on the other hand.

Complete Presentation of the Invention:

This invention relates to a process for the production of multibranched paraffins with 7 carbon atoms, making it possible to obtain an isomerate having an octane number that is at least equal to 80, with an aromatic compound content of less than 1%, starting with a feedstock comprising mostly hydrocarbons with 7 carbon atoms belonging to the families of paraffins, naphthenes, and aromatic compounds. In the following description, the abbreviation $C_7$ fraction will be used to designate a feedstock comprising mostly hydrocarbons with 7 carbon atoms, this $C_7$ fraction being generally obtained from a naphtha from a first distillation, and having a chemical composition that varies with the origin of the naphtha fraction in the typical ranges given below:

normal heptane from 20 to 35% by weight,
methyl-2 hexane from 5 to 10% by weight,
methyl-3 hexane from 10 to 15% by weight,
methyl cyclohexane from 10 to 25% by weight,
toluene from 4 to 15% by weight.

This $C_7$ fraction is thus composed of C7 paraffins, almost equally distributed among monobranched and normal paraffins, $C_7$ naphthenes whose main representative is methyl cyclohexane, and $C_7$ aromatic compounds, whose only representative is toluene.

One object of the process of the invention is to transform this $C_7$ fraction into a fraction containing mostly, i.e., at least 70% by weight, preferably at least 85% by weight, multibranched $C_7$ paraffins, i.e., having a degree of branching higher than or equal to two.

These multibranched paraffins will confer on the corresponding fraction a high research octane number (RON), i.e., at least 80, and which can reach and even exceed 87. This octane number can in practice be slightly lower because of the residual presence of about 10% or less of normal and monobranched paraffins.

The transformation of the starting $C_7$ fraction into the final $C_7$ fraction, composed of mostly dibranched paraffins, requires several types of reactions:

1) The transformation of normal paraffins into branched paraffins, and monobranched paraffins into multibranched paraffins, which is performed by an isomerization unit operating under partial hydrogen pressure, and which for this reason is called a hydroisomerization unit.
2) The transformation of naphthenes, essentially methyl cyclohexane, into multibranched paraffins, which requires a first step of opening the naphthene ring to transform the methyl cyclohexane into paraffins, then the subsequent transformation of these paraffins into multibranched paraffins in the isomerization unit. The unit for opening the naphthene rings is also operated under partial hydrogen pressure.
3) The transformation of toluene into methyl cyclohexane, which takes place either in a specific hydrogenation unit or in the isomerization unit, or in the ring opening unit.

The invention relates more specifically to the treatment of the fraction with 7 carbon atoms and makes it possible to transform said $C_7$ fraction, obtained from the first distillation naphtha, into a fraction with 7 carbon atoms composed mostly of di- and tri-branched paraffins, i.e., containing at least 70% by weight, preferably at least 85% by weight, of multibranched paraffins.

To achieve these transformations, the process makes use of at least one isomerization unit, a unit for opening naphthene rings, and a separation step comprising at least one distillation column, optionally completed by a unit making it possible to perform the separation of normal paraffins and mono-paraffins on the one hand, and di- and tri-branched paraffins on the other hand. These units are combined so as to recycle the methyl cyclohexane, the toluene, and the normal paraffins and monobranched paraffins to exhaustion.

Generally, a unit will be able to comprise one or more reactors.

The arrangements that are described in this invention make it possible to respond to the octane requirement with respect to admissible aromatic compound contents in the gasoline while maximizing the formation of multibranched paraffinic compounds after having separated the original naphtha fraction into 3 fractions:

1) A top fraction comprising essentially the compounds with 5 and 6 carbon atoms, which is sent into specific isomerization whose operating conditions and the catalyst can be different from those used for the isomerization of the $C_7$ fraction.
2) A fraction with 7 carbon atoms that is the object of the treatment described in this invention and that results in an effluent with 7 carbon atoms containing at least 70% by weight, preferably at least 85% by weight, of di- and tri-branched paraffins and whose octane number is at least 80, preferably between 80 and 87. This fraction with 7 carbon atoms can, before the treatment described in this invention, optionally be subjected to a pretreatment making it possible to reduce, to values of less than 0.5% by weight, the toluene content, using a specific hydrogenation unit.
3) A bottom fraction containing essentially the compounds with 8 carbon atoms and more, which is sent into a catalytic reforming unit.

This invention thus relates to the treatment of the fraction with 7 carbon atoms obtained from the fractionation described above, but given the capabilities of the naphtha fractionation unit, up to 10% of lighter compounds, having 6 carbon atoms or less, and up to 10% of heavier compounds, having 8 carbon atoms and more, can be found in said $C_7$ fraction.

Another object of this invention is a process for the production of an isomerate with a RON that is at least equal to 80 and containing less than 1% by weight of aromatic compounds, starting with a fraction consisting mostly of hydrocarbons with 7 carbon atoms, and containing paraffins, naphthenes, and aromatic compounds, said process comprising at least one isomerization unit, at least one unit for opening naphthene rings, and at least one separation unit, characterized in that said units are combined so as to recycle the methyl cyclohexane, toluene, and normal paraffins and monobranched paraffins to exhaustion. In the initial fraction, consisting mostly of hydrocarbons with 7 carbon atoms, the paraffins, the naphthenes, and the aromatic compounds are in any proportion.

Exhaustion is defined as the fact of converting the methyl cyclohexane, the toluene, and the normal paraffins and monobranched paraffins by systematic recycling in an appropriate unit from the combination of units integrated into the process according to the invention, said compounds having first been isolated in at least one separation unit.

The process according to the invention has numerous variants depending on the point at which the fresh feedstock is introduced and on the various recyclings to the isomerization unit or to the ring opening unit, intended to exhaust the linear or monobranched paraffins, essentially with $C_7$ on the one hand, and the naphthene compounds, in particular methyl cyclohexane and aromatic compounds, in particular toluene, on the other hand. These variants all make it possible to produce an isomerate with a RON that is at least equal to 80 and containing less than 1% by weight of aromatic compounds starting with a fraction consisting mostly of hydrocarbons with 7 carbon atoms and containing paraffins, naphthenes, and aromatic compounds in any proportion.

In variants 1 to 6 described below, at least one of the separation units is a distillation column fed by a mixture of different streams, at least one of which is obtained from the fresh feedstock and from which is extracted a) a top stream which, after optional supplemental separation, provides the produced isomerate, b) a lateral stream that feeds, alone or in a mixture, one of the isomerization units, from which the normal paraffins and monobranched paraffins are converted to exhaustion, and c) a bottom stream from which the toluene and the methyl cyclohexane contained in the fresh feedstock are recycled to exhaustion.

Up to 1% by weight of $nC_7$ can be tolerated in the isomerate constituting the top stream but if possible less than 0.5% by weight.

In the preferred variant among variants 1 to 6 described above (cf. FIG. 1), a first isomerization unit is fed by a side draw-off obtained from the distillation column, the isomerization effluent, after stabilization, being sent to the distillation column on a plate located above the plate of the side draw-off, the fresh feedstock feeds the distillation column, and the ring opening unit is fed by the bottom stream from said column, the effluent from the ring opening unit being recycled at the inlet of the isomerization unit, mixed with the side draw-off stream obtained from said column.

In a second variant of the invention, an isomerization unit is fed by the side draw-off obtained from the distillation column, the effluent from the isomerization, after stabilization, being sent to the distillation column on a plate located above the side draw-off plate, the fresh feedstock feeds the distillation column and the ring opening unit is fed by the bottom stream from said column, the effluent from the ring opening unit being recycled, mixed with the fresh feedstock, at the inlet of said column.

In a third variant of the invention, one of the isomerization units, called first isomerization, is fed by the side draw-off obtained from the distillation column, the effluent from this first isomerization, after stabilization, being sent to the distillation column on a plate located above the side draw-off plate, the fresh feedstock feeds a second isomerization unit, separate from the first isomerization unit, the effluent from this second isomerization unit, after stabilization, being sent as feedstock from the distillation column and the ring opening unit being fed by the bottom stream from the distillation column, the effluent from the ring opening unit being recycled, mixed with the fresh feedstock, to the inlet of the second isomerization unit.

In a fourth variant of the invention, one of the isomerization units, called first isomerization, is fed by side draw-off obtained from the distillation column, the effluent from this first isomerization, after stabilization, being sent to the distillation column on a plate located above the side draw-off plate, the fresh feedstock feeds the ring opening unit, and effluent from this ring opening unit feeds a second isomerization unit, separate from the first isomerization, and the effluent from this second isomerization unit, after stabilization, feeds the distillation column, the bottom stream from the distillation column feeding, mixed with the fresh feedstock, the ring opening unit.

In a fifth variant of the invention, one of the isomerization units, called first isomerization, is fed by the side draw-off obtained from the distillation column, the effluent of this first isomerization, after stabilization, being sent to the distillation column on a plate located above the side draw-off plate, the fresh feedstock feeds the distillation column, and the bottom stream from the distillation column feeds the ring opening unit, the effluent of this ring opening unit feeds a second isomerization unit, separate from the first isomerization, the effluent of this second isomerization, after stabilization, feeds, mixed with fresh feedstock, the distillation column.

In a sixth variant of the process according to the invention, equally applicable to each of the variants already cited (1 to 5), the top stream from the distillation column is sent into a separation unit from which is extracted, on the one hand, normal paraffins and mono-paraffins that are recycled either to the inlet of the column, mixed with the fresh feedstock, or to the inlet of the first isomerization unit, mixed with the side draw-off stream, and on the other hand, a stream rich in di- and tri-branched paraffins, which constitutes the isomerate produced.

The separation unit used can be based on any technique known to one skilled in the art, for example, an adsorption unit on a molecular sieve such as the one described in Patent Application US2002/0045793 A1. The adsorbent used in said unit can be any adsorbent known to one skilled in the art that makes it possible to perform this separation, for example the adsorbents described in U.S. Pat. No. 6,353,144, Patent Application FR 02/09841 (nonhomogeneous adsorbent consisting of at least one crystal formed by a core and a continuous exterior layer having a diffusional selectivity greater than 5) and Patent Application US2002/0045793 A1. One or more membrane-type modules can also be envisioned for use for this separation, as described in, for example, Patent Application EP-A1-0 922 748.

For each of variants 1 to 6, the distillation column optionally can be of the column type with an internal wall (divided-wall column in English terminology), which is a technology that can be applied well in the case where a side draw-off is present.

In variants 7 to 9 described below, one of the separation units used is fed by a mixture of different streams, at least one of which is obtained from the fresh feedstock, and normal paraffins and mono-paraffins are extracted from this separation unit, on the one hand, and are recycled at the inlet of the isomerization unit and, on the other hand, a stream rich in di- and tri-branched paraffins and naphthene compounds is extracted, which feeds a distillation column from which is extracted a) a top stream, which is the produced isomerate, and b) a bottom stream from which the toluene and the methyl cyclohexane contained in the fresh feedstock are recycled to exhaustion.

Up to 1% by weight of nC7 can be tolerated in the isomerate constituting the top stream but if possible less than 0.5% by weight.

In a seventh variant of the process according to the invention, the fresh feedstock feeds an isomerization unit, the isomerization effluent, after stabilization, feeds the separation unit from which is extracted, on the one hand, normal paraffins and mono-paraffins that are recycled at the inlet of the isomerization unit, mixed with the fresh feedstock, and, on the other hand, a stream rich in di- and tri-branched paraffins and in naphthene rings, which feeds the distillation column whose top stream constitutes the isomerate and whose bottom stream, rich in naphthene compounds, is sent as feedstock to the ring opening unit, whose effluent is recycled at the inlet of the isomerization unit, mixed with the fresh feedstock and the recycled material coming from the separation unit.

In an eighth variant of the process according to the invention, the fresh feedstock feeds, after stabilization, the separation unit, from which is extracted, on the one hand, the normal paraffins and mono-paraffins, which are recycled at the inlet of the isomerization unit and, on the other hand, a stream rich in di- and tri-branched paraffins and in naphthene rings, which feeds the distillation column whose top stream constitutes the isomerate and whose bottom stream, rich in naphthene compounds, is sent as feedstock to the ring opening unit, whose effluent is recycled, mixed with the fresh feedstock and the effluent from the isomerization unit to the inlet of the stabilization.

In a ninth variant of the process according to the invention, the fresh feedstock feeds a ring opening unit, the effluent from said unit feeds an isomerization unit, the effluent from the isomerization unit, after stabilization, feeds the separation unit from which is extracted, on the one hand, normal paraffins and mono-paraffins, which are recycled at the inlet of the isomerization unit, mixed with the effluent from the ring opening unit and, on the other hand, a stream rich in di- and tri-branched paraffins and in naphthene rings, which feeds the distillation column, whose top stream constitutes the isomerate, and whose bottom stream, rich in naphthene compounds, is recycled as feedstock for the ring opening unit, mixed with the fresh feedstock.

In variants 10 to 13 described below, one of the separation units used is a distillation column fed by a mixture of different streams, at least one of which is obtained from the fresh feedstock, from which is extracted a) a top stream that feeds a second separation unit from which is extracted, on the one hand, normal paraffins and mono-paraffins that are recycled at the inlet of one of the isomerization units and, on the other hand, a stream rich in di- and tri-branched paraffins, which is the produced isomerate, and b) a bottom stream from which the toluene and the methyl cyclohexane contained in the fresh feedstock are recycled to exhaustion.

Up to 1% by weight of $nC_7$ can be tolerated in the isomerate but if possible less than 0.5% by weight.

In a tenth variant of the process according to the invention, the fresh feedstock feeds an isomerization unit, the isomerization effluent, after stabilization, feeds the distillation column, whose top stream feeds the separation unit from which is extracted, on the one hand, the normal paraffins and mono-paraffins that are recycled at the inlet of the isomerization unit, mixed with the fresh feedstock and, on the other hand, a stream rich in di- and tri-branched paraffins that constitutes the isomerate, the bottom stream from the distillation column, rich in naphthene compounds, is sent as feedstock for a ring opening unit whose effluent is recycled at the inlet of the isomerization unit, mixed with fresh feedstock and the recycled material coming from the separation unit.

In an eleventh variant of the process according to the invention, the fresh feedstock, after stabilization, feeds the distillation column whose top stream feeds the separation unit from which is extracted, on the one hand, the normal paraffins and mono-paraffins that are recycled at the inlet of a first isomerization unit, and, on the other hand, a stream rich in di- and tri-branched paraffins, which constitutes the isomerate, the bottom stream of the column, rich in naphthene compounds, is sent as feedstock for a ring opening unit whose effluent is sent as feedstock for a second isomerization unit whose effluent is recycled, mixed with fresh feedstock and the effluent recycled from the first isomerization unit at the inlet of the stabilization.

In a twelfth variant of the process according to the invention, the fresh feedstock feeds a ring opening unit, the effluent from said unit feeds an isomerization unit, the effluent from this isomerization unit, after stabilization, feeds the distillation column, whose top stream feeds the separation unit from which is extracted, on the one hand, the normal paraffins and mono-paraffins that are recycled at the inlet of the isomerization unit, mixed with the effluent from the ring opening unit and, on the other hand, a stream rich in di- and tri-branched paraffins, which constitutes the isomerate, the bottom stream from the column is recycled as feedstock for the ring opening unit, mixed with the fresh feedstock.

In a thirteenth variant of the process according to the invention, the fresh feedstock feeds a ring opening unit, the effluent from said unit, after stabilization, feeds the distillation column, whose top stream feeds the separation unit, from which is extracted, on the one hand, the normal paraffins and mono-paraffins, which are sent to the inlet of a first isomerization unit whose effluent is recycled at the inlet of the stabilization, mixed with the effluent from the ring opening unit, and on the other hand, a stream rich in di- and tri-branched paraffins, which constitutes the isomerate, the bottom stream from the column feeds a second isomerization unit, whose effluent is recycled as feedstock for the ring opening unit, mixed with the fresh feedstock.

In the context of this invention and of the different variants of the process according to the invention, a stream "rich" in a compound is defined as a stream whose composition by weight is such that said compound represents at least 50% by weight, preferably at least 65% by weight and, still more preferably, at least 80% by weight of the total composition.

For each of variants 1 to 13, the hydrogenation of toluene can be performed in a specific hydrogenation unit. This unit can be placed so as to treat all of the fresh feedstock, or so as to treat only the feedstock for the ring opening unit or one of the isomerization units.

BRIEF DESCRIPTION OF DRAWING

The detailed description of the invention is made by means of FIG. 1, which shows a diagram of the process of the invention in one of its preferred variants. The detailed description of this variant includes the example that illustrates it.

Other variants are possible, but will not all be described in detailed fashion.

In the example that illustrates the preferred variant (cf. FIG. 1), the feedstock to be treated (1) is introduced into a distillation column (A) comprising 88 real plates at the level of plate 50. In the example in question, fresh feedstock (1) has the following composition (% by weight) and a mass flow rate provided below:

| | % By Weight |
|---|---|
| Dimethyl 2-3 butane | 0.01 |
| Methyl-2 pentane | 0.10 |
| Methyl-3 pentane | 0.14 |
| n-Hexane | 1.41 |
| Methyl cyclopentane | 0.79 |
| Cyclohexane | 1.64 |
| Benzene | 0.18 |
| Trimethyl 2-2-3 butane | 0.06 |
| Dimethyl 2-2 pentane | 0.15 |
| Dimethyl 2-3 pentane | 3.66 |
| Dimethyl 2-4 pentane | 0.42 |
| Dimethyl 3-3 pentane | 0.24 |
| Methyl-2 hexane | 9.39 |
| Methyl-3 hexane | 12.68 |
| Ethyl-3 pentane | 1.16 |
| n-Heptane | 31.20 |
| Dimethyl-1,1 cyclopentane | 0.89 |
| cis-Dimethyl-1,3 cyclopentane | 2.40 |
| Trans-dimethyl-1,3 cyclopentane | 2.29 |
| Trans-dimethyl-1,2 cyclopentane | 4.33 |
| Methyl cyclohexane | 12.43 |
| Ethyl cyclopentane | 0.70 |
| Toluene | 13.23 |
| $C_{8+}$ | 0.50 |
| Total flow rate (kg/h) | 11117 |

A stream (2) corresponding to the produced isomerate exits at the top of column (A), and its composition by weight and the mass flow rate are as follows:

| | |
|---|---|
| Isopentane | 4.23 |
| Dimethyl 2-2 butane | 0.22 |
| Dimethyl 2-3 butane | 0.18 |
| Methyl-2 pentane | 0.83 |
| Methyl-3 pentane | 0.53 |
| n-Hexane | 2.21 |
| Methyl cyclopentane | 0.97 |
| Cyclohexane | 1.93 |
| Benzene | 0.18 |
| Trimethyl 2-2-3 butane | 8.12 |
| Dimethyl 2-2 pentane | 22.04 |
| Dimethyl 2-3 pentane | 0.88 |
| Dimethyl 2-4 pentane | 47.23 |
| Dimethyl 3-3 pentane | 3.07 |
| Methyl-2 hexane | 4.34 |
| Methyl-3 hexane | 1.79 |

-continued

| | |
|---|---|
| Ethyl-3 pentane | 0.06 |
| n-Heptane | 0.50 |
| Dimethyl-1,1 cyclopentane | 0.20 |
| cis-Dimethyl-1,3 cyclopentane | 0.08 |
| Trans-dimethyl-1,3 cyclopentane | 0.07 |
| Trans-dimethyl-1,2 cyclopentane | 0.06 |
| Methyl cyclohexane | 0.28 |
| Ethyl cyclopentane | 0.00 |
| Toluene | 0.00 |
| $C_{8+}$ | 0.00 |
| Total flow rate (kg/h) | 9317 |

The RON of this isomerate (stream 2) is 84.2 and its aromatic compound content is 0.18% by weight. At the level of plate 44, a stream (3) containing mostly (at least 70%) normal heptane and monobranched $C_7$ paraffins is withdrawn.

At the bottom of column (A), a stream (4), which is a stream rich in methyl cyclohexane, toluene, and n-heptane, is withdrawn.

This stream (4) is sent into a hydrogenation unit specifically for toluene (B), then into a ring opening unit (C), which produces an effluent (5) containing mainly a mixture of paraffins resulting in part from the opening of rings, as well as unconverted methyl cyclohexane, the toluene being totally hydrogenated.

The catalyst used for the ring opening unit can be any catalyst making it possible to convert, by ring opening, at least 5% of the methyl cyclohexane present in the mixture to be treated. In the example illustrating the preferred variant, the ring opening unit uses a catalyst with a base of iridium deposited on alumina or silica-alumina, such as the one described in Patent Application WO 02/07881.

The ring opening unit is operated under the following conditions:

Temperature=300° C.

Pressure=14 bar.eff

PPH=10 $h^{-1}$

Molar ratio of hydrogen/hydrocarbon=6 mol/mol.

The composition by weight and the mass flow rate (except for hydrogen) of stream (5) corresponding to the effluent of the ring opening unit are as follows:

| | |
|---|---|
| $C_{5-}$ | 1.82 |
| $C_5$ Paraffins | 3.69 |
| $C_6$ Paraffins | 1.72 |
| Methyl cyclopentane | 0.00 |
| Cyclohexane | 0.00 |
| Benzene | 0.00 |
| $C_7$ Paraffins | 71.13 |
| Dimethyl-1,1 cyclopentane | 0.39 |
| cis-Dimethyl-1,3 cyclopentane | 0.37 |
| Trans-dimethyl-1,3 cyclopentane | 0.40 |
| Trans-dimethyl-1,2 cyclopentane | 0.40 |
| Methyl cyclohexane | 19.18 |
| Ethyl cyclopentane | 0.39 |
| Toluene | 0.00 |
| $C_{8+}$ | 0.51 |
| Total flow rate (kg/h) | 10962 |

Stream (5) is mixed with stream (3) to yield a stream (6), which is introduced into an isomerization unit (D) using a catalyst with a base of platinum on chlorinated alumina, as described in Patent Application U.S.2002/0002319 A1.

The isomerization unit operates under the following conditions:

Temperature=90° C.

Pressure=30 bar.eff

PPH=1 $h^{-1}$

Molar ratio of hydrogen/hydrocarbon=0.2 mol/mol.

The composition by weight and the mass flow rate (except hydrogen) of stream (7) corresponding to the effluent from the isomerization unit are as follows:

| | |
|---|---|
| $C_{5-}$ | 2.54 |
| Isopentane | 0.56 |
| Dimethyl 2-2 butane | 0.03 |
| Dimethyl 2-3 butane | 0.02 |
| Methyl-2 pentane | 0.10 |
| Methyl-3 pentane | 0.05 |
| n-Hexane | 0.12 |
| Methyl cyclopentane | 0.04 |
| Cyclohexane | 0.10 |
| Benzene | 0.00 |
| Trimethyl 2-2-3 butane | 1.63 |
| Dimethyl 2-2 pentane | 3.26 |
| Dimethyl 2-3 pentane | 4.08 |
| Dimethyl 2-4 pentane | 8.16 |
| Dimethyl 3-3 pentane | 4.08 |
| Methyl-2 hexane | 22.04 |
| Methyl-3 hexane | 16.32 |
| Ethyl-3 pentane | 0.82 |
| n-Heptane | 21.22 |
| Dimethyl-1,1 cyclopentane | 0.33 |
| cis-Dimethyl-1,3 cyclopentane | 0.32 |
| Trans-dimethyl-1,3 cyclopentane | 0.34 |
| Trans-dimethyl-1,2 cyclopentane | 0.32 |
| Methyl cyclohexane | 13.20 |
| Ethyl cyclopentane | 0.32 |
| Toluene | 0.00 |
| $C_{8+}$ | 0.00 |
| Total flow rate (kg/h) | 70847 |

Effluent (7) from the isomerization unit is sent into a stabilization column (E) from where a stream (9) comprising light gases that result from cracking reactions within the isomerization unit ($C_{5-}$ fraction) exits from the top and a stream (8) whose composition is very close to that of stream (7) exits from the bottom and is reintroduced at the top of column (A) at the level of plate 12.

The mass flow rate (except hydrogen) of stream (9) goes up to 1800 kg/h.

It can be verified overall that the mass flow rate of stream (1) is equal to the sum of the mass flow rates of streams (2) and (9).

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius, and all parts and percentages are by weight, unless otherwise indicated.

The entire disclosures of all applications, patents and publications, cited herein and of corresponding French Application No. 03/08.570, filed Jul. 11, 2003, are incorporated by reference herein.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for the production of an isomerate with a RON that is at least equal to 80, formed by at least 70% by weight of multibranched $C_7$ paraffins and containing less than 1% by weight of aromatic compounds, starting with a fraction comprising mostly of hydrocarbons with 7 carbon atoms, and containing paraffins, naphthenes, and aromatic compounds, said process comprising at least one isomerization unit, at least one unit for opening naphthene rings, and at least one separation unit, characterized in that said units are combined so as to recycle, to exhaustion, methyl cyclohexane, toluene, and normal paraffins and monobranched paraffins, and wherein at least one of the separation units is a distillation column fed by a mixture of different streams, at least one of which is obtained from fresh feedstock, and from which is extracted a) a top stream which, after optional supplemental separation, provides the produced isomerate, b) a side stream from a side draw-off plate that feeds, alone or in a mixture, a first isomerization unit having an inlet and an outlet, from which the normal paraffins and monobranched paraffins are converted to exhaustion, and c) a bottom stream, from which the toluene and the methyl cyclohexane contained in the fresh feedstock are recycled to exhaustion, wherein the isomerization effluent from the first isomerization unit, after stabilization, is sent to said distillation column on a plate located above the side draw-off plate, and wherein the fresh feedstock feeds the distillation column and wherein the ring opening unit is fed by the bottom stream from said column, part of the effluent from this ring opening unit being recycled to the inlet of the isomerization unit, mixed with the side draw-off stream obtained from said distillation column, and another part of the effluent from this ring opening unit being recycled, mixed with fresh feedstock, and fed to said distillation column.

2. A process according to claim 1, wherein the fresh feedstock feeds a second isomerization unit, the effluent from this second isomerization unit, after stabilization, being sent as feedstock to the distillation column, and wherein the ring opening unit is fed by the bottom stream from the distillation column, the effluent from the ring opening unit being recycled, mixed with the fresh feedstock, at the inlet of said second isomerization column.

3. A process according to claim 1, wherein the fresh feedstock feeds the ring opening unit, the effluent from said unit feeds a second isomerization unit, the effluent from this second isomerization unit, after stabilization, feeds the distillation column and wherein the bottom stream from the distillation column, mixed with fresh feedstock, feeds the ring opening unit.

4. A process according to claim 1, wherein the fresh feedstock feeds the distillation column and wherein the bottom stream from the distillation column feeds the ring opening unit, the effluent from said unit feeds a second isomerization unit, the effluent from this second isomerization unit, after stabilization and mixed with fresh feedstock, feeds said distillation column.

5. A process according to claim 1, wherein the top stream from the distillation column is sent into a separation unit from which is extracted, on the one hand, the normal paraffins and mono-paraffins that are recycled either at the inlet of the column, mixed with fresh feedstock, or at the inlet of the first isomerization unit, mixed with the side draw-off stream and, on the other hand, a stream rich in di- and tri-branched paraffins.

6. A process according to claim 1, wherein the distillation column is of the column type with an internal wall.

7. A process according to claim 1, wherein one of the separation units used is fed by a mixture of different streams, at least one of which is obtained from the fresh feedstock, and wherein normal paraffins and mono-paraffins that are recycled at the inlet of an isomerization unit are extracted from this separation unit, on the one hand, and, on the other hand, a stream rich in di- and tri-branched paraffins and in naphthene compounds is extracted and it feeds a distillation column from which is extracted a) a top stream, which is the produced isomerate, and b) a bottom stream from which the toluene and the methyl cyclohexane contained in the fresh feedstock are recycled to exhaustion.

8. A process according to claim 7, wherein the fresh feedstock feeds an isomerization unit, the effluent from said unit, after stabilization, feeds the separation unit from which is extracted, on the one hand, the normal paraffins and mono-paraffins that are recycled at the inlet of the isomerization unit, mixed with fresh feedstock, and, on the other hand, a stream rich in di- and tri-branched paraffins and in naphthene rings, which feeds the distillation column whose top stream constitutes the isomerate, and whose bottom stream, rich in naphthene compounds, is sent as feedstock to the ring opening unit, whose effluent is recycled at the inlet of the isomerization unit, mixed with fresh feedstock and with recycled material coming from the separation unit.

9. A process according to claim 7, wherein the fresh feedstock, after stabilization, feeds the separation unit from which is extracted, on the one hand, the normal paraffins and mono-paraffins that are recycled at the inlet of an isomerization unit and, on the other hand, a stream rich in di- and tri-branched paraffins and in naphthene rings, which feeds the distillation column whose top stream constitutes the isomerate and whose bottom stream, rich in naphthene compounds, is sent as feedstock to a ring opening unit, whose effluent is recycled, mixed with fresh feedstock and the effluent from the isomerization unit, at the inlet of the stabilization.

10. A process according to claim 7, wherein the fresh feedstock feeds a ring opening unit, the effluent from said unit feeds an isomerization unit, the effluent from this isomerization unit, after stabilization, feeds the separation unit from which is extracted, on the one hand, the normal paraffins and mono-paraffins that are recycled at the inlet of the isomerization unit, mixed with the effluent from the ring opening unit, and, on the other hand, a stream rich in di- and tri-branched paraffins and in naphthene rings, which feeds the distillation column, whose top stream constitutes the isomerate, and whose bottom stream, rich in naphthene compounds, is recycled as feedstock to the ring opening unit, mixed with fresh feedstock.

11. A process according to claim 1, wherein one of the separation units used is a distillation column fed by a mixture of different streams, at least one of which is obtained from fresh feedstock, from which is extracted a) a top stream that feeds a second separation unit, from which is extracted, on the one hand, the normal paraffins and mono-paraffins that are recycled at the inlet of one of the isomerization units and, on the other hand, a stream rich in di- and tri-branched paraffins, which is the isomerate produced, and b) a bottom stream, from which the toluene and the methyl cyclohexane contained in the fresh feedstock are recycled.

12. A process according to claim 11, wherein the fresh feedstock feeds an isomerization unit, the effluent from said unit, after stabilization, feeds the distillation column, whose top stream feeds the separation unit, from which is extracted, on the one hand, the normal paraffins and mono-paraffins that are recycled at the inlet of the isomerization unit, mixed with fresh feedstock, and, on the other hand, a stream rich in di- and tri-branched paraffins, which constitutes the isomerate, the bottom stream of the column, rich in naphthene compounds, is sent as feedstock to a ring opening unit, whose effluent is recycled at the inlet of the isomerization unit, mixed with fresh feedstock and the recycled material coming from the separation unit.

13. A process according to claim 11, wherein the fresh feedstock, after stabilization, feeds the distillation column whose top stream feeds the separation unit, from which is extracted, on the one hand, the normal paraffins and mono-paraffins that are recycled at the inlet of a first isomerization unit and, on the other hand, a stream rich in di- and tri-branched paraffins, which constitutes the isomerate, the bottom stream of the column, rich in naphthene compounds, is sent as feedstock to a ring opening unit, whose effluent is sent, as feedstock, to a second isomerization unit, whose effluent is recycled, mixed with fresh feedstock and the recycled effluent from the first isomerization unit, at the inlet of the stabilization.

14. A process according to claim 11, wherein the fresh feedstock feeds a ring opening unit, the effluent from said unit feeds an isomerization unit, the effluent from this isomerization unit, after stabilization, feeds the distillation column, whose top stream feeds the separation unit, from which is extracted, on the one hand, the normal paraffins and mono-paraffins, which are recycled at the inlet of the isomerization unit, mixed with the effluent from the ring opening unit, and, on the other hand, a stream rich in di- and tri-branched paraffins, which constitutes the isomerate, the bottom stream from the column is recycled as feedstock to the ring opening unit, mixed with fresh feedstock.

15. A process according to claim 11, wherein the fresh feedstock feeds a ring opening unit, the effluent from said unit, after stabilization, feeds the distillation column, whose top stream feeds the separation unit, from which is extracted, on the one hand, normal paraffins and mono-paraffins, which are sent to the inlet of a first isomerization unit whose effluent is recycled at the inlet of the stabilization, mixed with the effluent from the ring opening unit, and, on the other hand, a stream rich in di- and tri-branched paraffins, which constitutes the isomerate, the bottom stream of the column feeds a second isomerization unit, whose effluent is recycled as feedstock to the ring opening unit, mixed with fresh feedstock.

16. A process according to claim 1, wherein the toluene is hydrogenated in a specific hydrogenation unit, this unit being placed either so as to treat all of the fresh feedstock, or so as to treat only the feedstock for the ring opening unit or one of the isomerization units.

17. A process according to claim 1, wherein the toluene-containing bottom stream (c) is subjected to hydrogenation prior to being fed to the isomerization unit.

* * * * *

UNITED STATES PATENT AND TRADEMARK OFFICE

CERTIFICATE OF CORRECTION

PATENT NO. : 7,273,958 B2
APPLICATION NO. : 10/887223
DATED : September 25, 2007
INVENTOR(S) : Laurent Bournay It is certified that error appears in the above-identified patent and that said Letters Patent is hereby corrected as shown below:

On the TITLE page, ITEM (75) Inventors: line 1, reads “Lyons” should read -- Lyon --
On the TITLE page, ITEM (75) Inventors: line 3, reads “Lyons” should read -- Lyon --
On the TITLE page, ITEM (75) Inventors: line 4, reads “Lyons” should read -- Lyon --

Signed and Sealed this

Fifteenth Day of April, 2008

JON W. DUDAS
*Director of the United States Patent and Trademark Office*